US005771519A

United States Patent [19]

Hrunek

[11] Patent Number: 5,771,519

[45] Date of Patent: Jun. 30, 1998

[54] BRUSHLESS HANDLE CONTROLLED ARTICLE COLLECTOR

[76] Inventor: Brenda J. Hrunek, 810 Medford, Carol Stream, Ill. 60188

[21] Appl. No.: 661,195

[22] Filed: Jun. 10, 1996

[51] Int. Cl.[6] ..... A47L 13/00

[52] U.S. Cl. ..... 15/104.001; 15/144.1

[58] Field of Search ..... 15/104.001, 144.1, 15/228, 235.4, 245.1; 37/265, 278, 285; 294/19.2, 54.5

[56] References Cited

U.S. PATENT DOCUMENTS

| | | | |
|---|---|---|---|
| D. 232,617 | 9/1974 | Albrecht . | |
| D. 321,793 | 11/1991 | Bryant | D4/135 |
| 1,918,611 | 7/1933 | Oberti | 15/144.1 X |
| 2,817,405 | 12/1957 | Pearson | 294/19.2 X |
| 3,091,790 | 6/1963 | Schroeder | 294/54.5 X |
| 3,538,533 | 11/1970 | Woods . | |
| 3,682,516 | 8/1972 | Savage . | |
| 4,349,933 | 9/1982 | Thompson | 15/118 |
| 4,602,401 | 7/1986 | Holroyd | 15/144.1 X |
| 4,669,206 | 6/1987 | Yost | 294/54.5 X |
| 5,117,530 | 6/1992 | Rank | 294/54.5 X |

*Primary Examiner*—Mark Spisich

*Attorney, Agent, or Firm*—Meroni & Meroni

[57] ABSTRACT

This invention concerns a handle controlled article collector for collecting articles on a floor surface. The invention comprises a rigid elongated floor engaging head having a first end and a second end. The floor engaging head is further defined by a bottom plate, a concave front surface portion, and a pair of shoulder members overlying the bottom plate and integrally connected therewith. The shoulder members are separated by a completely slotted center portion located substantially midway between the first and second ends of the floor engaging head. Each shoulder member extends away from the slotted center portion in an opposite direction. The slotted center portion has a bottom portion. A pin has a first end and a second end. A handle member has a front end. The front end of the handle member is pivotally mounted in spaced relation above the bottom portion of the slotted center portion in the slotted center portion by the pin. The pin extends through the front end of the handle member and is rigidly secured at its first and second ends to respective shoulder members. The bottom plate has a smooth substantially flat bottom planar surface for slidably engaging the floor surface. The concave front surface portion is adapted to collect the articles on the floor surface and to maintain the articles in relative position between the first and second ends of the floor engaging head when it is pushed in a forward direction across the floor surface to collect the articles.

11 Claims, 1 Drawing Sheet

BRUSHLESS HANDLE CONTROLLED ARTICLE COLLECTOR

BACKGROUND OF THE INVENTION

1. Field of the Invention

The present invention relates generally to a handle controlled manual push-type article collecting or gathering device. More specifically, my invention relates to a manual push-type brushless handle controlled article collector for gathering children's toys or the like that are scattered or positioned at various locations on a floor surface throughout one's home or work place.

2. Description of the Prior Art

Push-type brooms have been around for a long time. These brooms have been used to give a standing person the ability to easily push a bristle filled head across a floor surface without having to bend down in order to sweep or collect dust, dirt, debris and the like on a floor surface. Several improvements have been made since the first push-type brooms with elongated handles have been used, all dependent on serving a particular function or solving a particle problem. Primary importance has been given to developing light weight broom heads and brooms that aid in the pick-up part of the ordinary forward sweeping motion employed by the average user of a push-type broom. Moreover, another requirement to aid these brooms in best achieving their sweeping purpose is to have the broom head rigidly attached to the handle. In this way, dust, dirt, debris and the like can be pushed forward and then the broom head lifted into the air by the handle, clear of the swept matter, and then pulled backward by the user who next places the broom head on the ground to make another forward sweeping motion to further clear the floor of any remaining dust, dirt, debris and the like. Were the broom head to flop down when the handle is lifted upward after the forward sweeping motion, the dust, dirt, debris and the like would tend to scatter all over as the broom head fell down and impacted the swept matter. Thus, defeating or at least lessening the ability of the broom and broom head to effectively sweep the floor surface.

Further, it should be understood that the traditional push-type broom head is intended to only engage the floor surface in a substantially parallel relationship for only a small part of an entire forward sweeping motion. Essentially the traditional forward sweeping motion consists of a downward scooping arc where the broom head only engages the floor surface when it is at the vertex of the arc and otherwise is airborne being carried by the operator to make another sweeping motion.

Further in this regard, and as viewed in the prior art cited in this application, another significant problem the push broom art has addressed is how to rigidly attach a handle to the broom head for durable extended use of the two components either in a removable screw-type relationship or in a permanently connected relationship. However, of all the prior art that has been reviewed by this inventor and of all the brooms that have been seen commercially available, not one offers a weighted bristleless or brushless rigid elongated floor engaging head having a pivotally mounted handle connected thereto. The reason no such device exists is because there has not been a need for such a device until recently.

With the increased growth of home day care facilities accommodating more and more children and with several of these facilities being operated by an individual adult or two adult partners, means are now needed to aid the adult in maintaining and cleaning up the children's play area, the adult's home, in a quick and efficient manner. Towards this end, the inventor of the Brushless Handle Controlled Article Collector has experimented with several existing push-type brooms, all to no avail.

In order for my invention to operate properly and be durable the handle must be securely mounted to the elongated floor engaging broom-type head but yet be flexible so that the elongated floor engaging head always remains flat on the floor surface being cleared. Additionally, the place where the handle meets the elongated floor engaging head must be as close to the floor as possible to be able to get level with articles on the floor surface and give more power to push these articles, such as a five to seven inch high toy truck. Also, were the handle to be fixedly mounted on the top surface of the elongated floor engaging head a front bottom edge of the head would tend to catch on the floor surface reducing the effective force available to collect articles as well as causing the elongated floor engaging head to want to roll over forward onto itself.

Unlike a traditional push-type broom, my invention is not intended to be lifted after each sweeping or collected motion and rather is slid along the floor surface being cleared. To this end, I have provided a weighted elongated floor engaging head that aids in the collection of larger objects on the floor, such as many children's toys or the like and not crumbs, dust, dirt, debris and the like. In operation, my invention is only lifted when repositioning it about a room, maybe ten times or less during clearing one room.

Further, my pivoting handle utilizes a low center of mass of the elongated floor engaging head by primarily translating the forward horizontal component of the pushing motion imparted to the handle by the user. The vertical component of the pushing motion imparted to the handle by the user in a traditional fixed handle push-type broom which would tend to simultaneously push the back edge of the broom head down and lift the front edge of the broom head up off of the floor surface is neutralized and/or translated by the pivotally mounted handle into forward horizontal motion. Also, my pivoting handle enables automatic adjustment to various heights of the operator while constantly maintaining the substantially parallel relationship with the floor surface when the rigid elongated floor engaging head is pushed in the forward direction across the floor surface.

Finally, my invention must have an elongated floor engaging head without brushes or bristles attached or protruding therefrom. Such brushes or bristles prevent easy sliding engagement with the floor surface being cleared and specifically a carpeted floor surface. Additionally, even on a smooth floor surface such a cement, linoleum or wood, brushes or bristles would allow smaller collected articles to pass through the bristles thereby substantially reducing the effectiveness of my invention.

All these features and requirements define my Brushless Handle Controlled Article Collector which is a device that drastically reduces time spent clearing toys. Instead of bending and stooping numerous times to pick up each article, one can easily and quickly clear several articles to a toy box where children can then put them in the box. No longer overwhelmed by a mess that covers a large area, a toddler can easily understand the task at hand. He or she has a pile of toys to put back into the toy box instead of a whole room to be picked up and put away. The best part is that the adult operator has to only invest a couple minutes of time at most. While teaching children to clean up their toys, this device helps kids keep focused in on a small area while the adult operator can sit and teach rather than walk about the room and pick up each article.

This invention saves time and is available for about the cost of a traditional push-type broom. My device can be stored under a sofa until it is needed. Also, my invention will straighten the pile in most carpets, removing foot prints, while it collects toys in a fraction of the time spent picking up each toy individually. Thus, a room cleared with my invention will be left orderly and looking just vacuumed.

My invention also could be used to collect articles such as pieces of wood, plastic, metal or the like. In this regard, the unique construction of my device permits the more substantial articles without also collecting dust, dirt, debris and the like on the floor surface. Then, the collected more substantial articles can be easily picked up and stored in another location as desired.

These and other types of push-type brooms disclosed in the prior art do not offer the flexibility and inventive features of my BRUSHLESS HANDLE CONTROLLED ARTICLE COLLECTOR. As will be described in greater detail hereinafter, the construction and features of the present invention differ from those previously proposed.

SUMMARY OF THE INVENTION

According to my present invention I have provided a brushless handle controlled article collector for collecting articles positioned at various locations on a floor surface comprising: a rigid elongated floor engaging head having a first end and a second end; the rigid elongated floor engaging head further defined by a bottom plate, a concave front surface portion, and a pair of shoulder members overlying the bottom plate; the bottom plate having a partially slotted center portion located substantially midway between the first end and the second end of the rigid elongated floor engaging head; the partially slotted center portion having a bottom portion; each of the pair of shoulder members independently rigidly connected to the bottom plate and being separated by a completely slotted center portion directly overlying and coinciding with the partially slotted center portion, each member of the pair of shoulder members extending away from the completely slotted center portion in an opposite direction; a handle member having a front end; a pin having a first end and a second end; the pin pivotally mounting the front end of the handle member in spaced relation above the bottom portion of the partially slotted center portion, the pin extending through a width of the front end of the handle member and traversing a distance between the pair of shoulder members within the completely slotted center portion, the first and second ends of the pin projecting within each respective member of the pair of shoulder members and being rigidly secured therein; the bottom plate having a smooth substantially flat bottom planar surface for slidably engaging the floor surface; and, the concave front surface portion adapted to collect the articles positioned at various locations on the floor surface and to maintain the articles in relative position between the first end and the second end of the rigid elongated floor engaging head when the rigid elongated floor engaging head is pushed in a forward direction across the floor surface to collect the articles.

Another feature of my invention relates to the brushless handle controlled article collector wherein the bottom plate is maintained in a substantially parallel relationship with the floor surface when the rigid elongated floor engaging head is pushed in the forward direction across the floor surface.

One specific way the just mentioned feature is attained is where the pin is located in a back half of the completely slotted center portion thereby utilizing a low center of mass in the rigid elongated floor engaging head to insure transmission of a pushing force through the handle member and into the rigid elongated floor engaging head while the bottom plate is maintained in a substantially parallel relationship with the floor surface when the rigid elongated floor engaging head is pushed in the forward direction across the floor surface.

Another way the just mentioned feature is attained is where an angle in a range of about 0 degrees to about 60 degrees between the handle member and the bottom plate is maintained when the rigid elongated floor engaging head is pushed in the forward direction across the floor surface.

Still another feature of my invention concerns the front end of the handle member being further defined by an angled front tip, the angled front tip being suspended above the bottom portion of the partially slotted center portion when an angle between the handle member and the bottom plate is in a range of about 0 degrees to about 60 degrees, and the angled front tip contacting a stop point in a front half of the bottom portion of the partially slotted center portion when the angle between the handle member and the bottom plate is greater than about 60 degrees thereby insuring non-reversibility of the handle member in relation to the rigid elongated floor engaging head.

According to important features of my invention I have also provided an outer surface of the front end of the handle member being co-planar with a top surface of the pair of shoulder members when the angle between the handle member and the bottom plate is about 0 degrees thereby positioning the brushless handle controlled article collector in a flat storage position.

Yet another feature of my invention I have provided is a second embodiment of my brushless handle controlled article collector where the rigid elongated floor engaging head is of a one-piece integrally molded construction.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
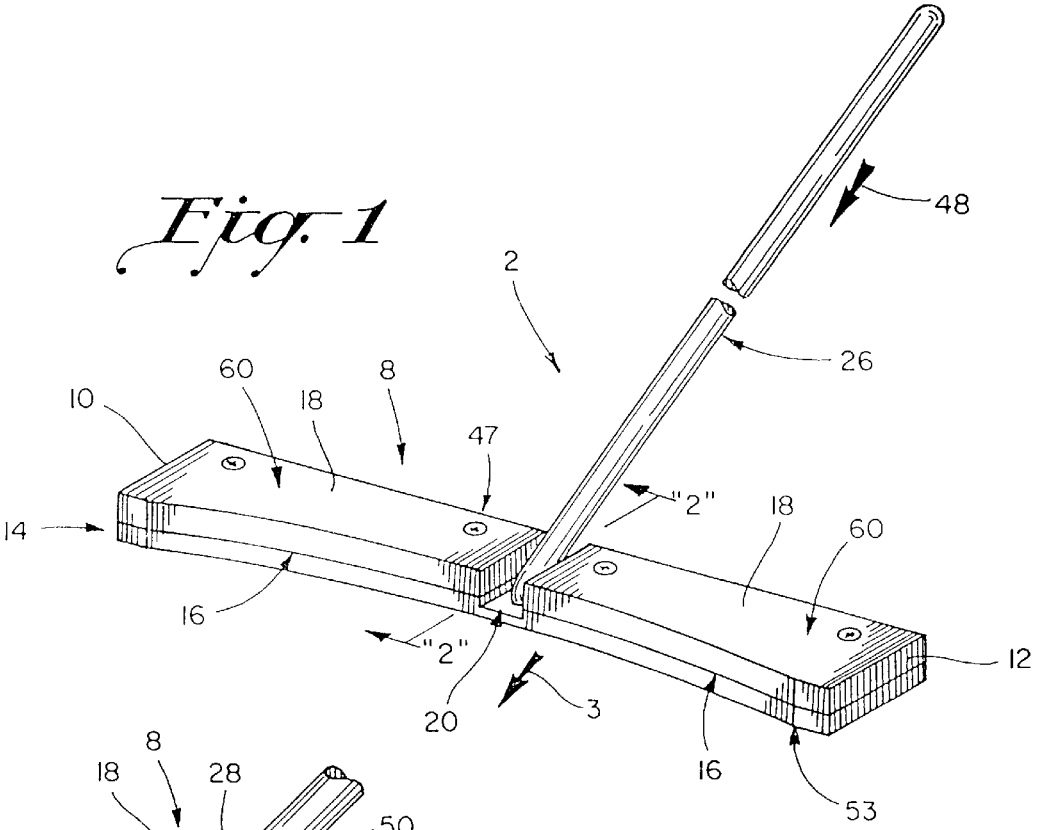
FIG. 1 is a top front perspective view of my brushless handle controlled article collector in accordance with the preferred embodiment of my present invention.
Figure 2:
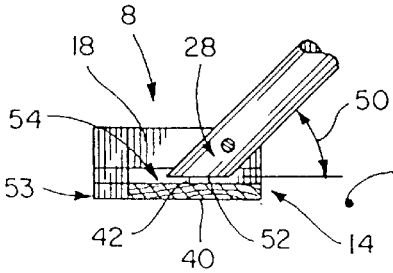
FIG. 2 is a cross sectional end view of my brushless handle controlled article collector shown in FIG. 1.
Figure 3:
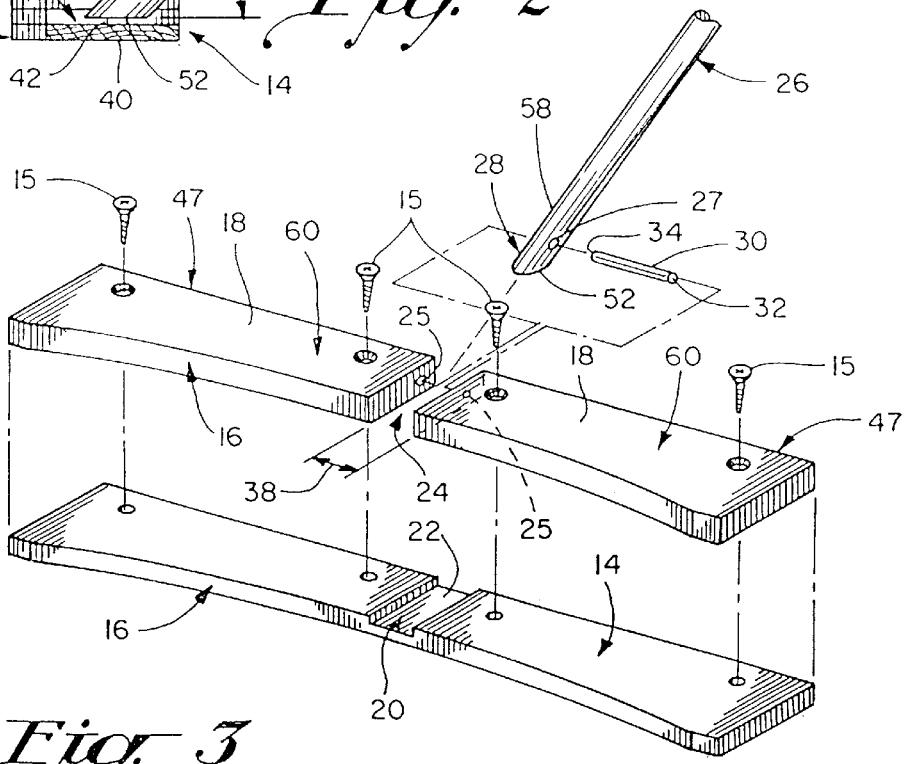
FIG. 3 is an assembly view of my brushless handle controlled article collector shown in FIG. 1.

Referring now to the drawings, FIG. 1 shows my new and improved brushless handle controlled article collector 2. My article collector 2 is manually pushed by an operator exerting a pushing force 48 in a forward direction 3 for collecting various articles (not shown in the drawings) on a floor surface, such as children's toys and the like or scraps of wood, plastic, metal and the like but not dust, dirt, debris and the like. My article collector 2 is primarily intended for use inside a building structure and operates excellently on a carpeted floor surface.

The article collector 2, once assembled, comprises two independently moving parts. The first part of the article collector 2 is a rigid elongated floor engaging head 8 having a first end 10 and a second end 12 located at opposite longitudinal ends of the floor engaging head. The floor engaging head 8 is further defined by a bottom plate 14, a concave front surface portion 16 and a pair of shoulder members 18 overlying the bottom plate 14.

The bottom plate 14 has a partially slotted center portion 20 located substantially midway between the first end and the second end of the floor engaging head 8. The partially slotted center portion 20 has a bottom portion 22 defined therein. Finally, the bottom plate has a smooth substantially flat bottom planar surface 40 for slidably engaging the floor surface in operation of the article collector.

The concave front surface portion 16 is adapted to collect the articles positioned at various locations on the floor surface. To this end, the concave front surface portion maintains the articles in relative position between the first end 10 and the second end 12 of the floor engaging head 8 when in operation the engaging head is pushed in the forward direction 3 across the floor surface to collect the articles located thereon.

Each of the pair of shoulder members 18 are independently rigidly connected to the bottom plate 14, preferably by wood-type metal screw fastening means 15 but it being understood that equivalent rigid fastening means could be utilized, such as glue or other fasteners, where the features and advantages of my claimed invention would still be maintained. Each of the pair of shoulder members is separated by a completely slotted center portion 24 which is located directly overlying and coinciding with the partially slotted center portion 20. Each member of the pair of shoulder members 18 extends away from the completely slotted center portion 24 in an opposite direction.

It should be understood that the preferred embodiment of my invention includes a partially slotted center portion 20 and completely slotted center portion as depicted in the drawings. However, it is contemplated as being the same invention if the partially slotted center portion 20 is replaced by the completely slotted center portion where a pin 30 is located as required in the completely slotted center portion to achieve the features of the pin location as hereafter defined in detail.

The final component of the first independently moving part of the article collector 2 is the pin 30. The pin 30 has a first end 32 and a second end 34 located at opposite longitudinal ends of the pin. The pin 30 extends through a width of a front end 28 of a handle member 26 (described further hereafter) and traverses a distance 38 between the pair of shoulder members within the completely slotted center portion 24.

The first and second ends of the pin, 32 and 34 respectively, project within each respective shoulder member 18 of the pair of shoulder members and is rigidly secured therein. The distance 38 is preferably slightly greater than the width of the front end of the handle member 26 so that no point on an outer surface 58 of the handle member constantly frictionally engages the pair of shoulder members 18. In other words, the distance 38 is great enough so that the front end of the handle member 26 can freely pivot on the pin 30 located in the partially slotted center portion 20, as described in more detail hereafter.

However, excellent results are further obtained when the distance 38 is not too much greater than the width of the front end of the handle member 26 so as to allow excess sliding of the handle member along the pin 30. In the preferred embodiment of my invention the distance 38 is greater than the width of the front end of the handle member 26 by a distance in the range of one-eighth of an inch to one-quarter of an inch.

The first and final component of the second independently moving part of the article collector 2 is the handle member 26. The handle member 26 has the front end 28 which is further defined by an angled front tip 52. The handle member 26 is pivotally mounted to the floor engaging head by the pin 30. To this end, the pin 30 extends through the width of the front end of the handle member and traverses the distance 38 between the pair of shoulder members within the completely slotted center portion 24.

The handle member 26 pivotally mounted with the floor engaging head 8 defines a relationship having several critical features for proper and acceptable operation of the article collector 2. First, it must be understood that when mounting the handle member 26, the front end 28 of the handle member, and more specifically the angled tip 52, be located in spaced relation 42 above the bottom portion 22 of the partially slotted center portion 20. This spaced relationship 42 allows for controlled pivotal movement between the handle member and the floor engaging head. Excellent results are obtained when the spaced relation 42 is such that it only allows pivotal movement between the handle member 26 and the bottom plate 14 of an angle 50 in a range of about 0 degrees to about 60 degrees.

Second, another important feature of the pivotal relationship is defined by the angled front tip 52 contacting a stop point 54 in a front half of the bottom portion 22 of the partially slotted center portion when the angle 50 between the handle member and the bottom plate is greater than about 60 degrees. This feature insures non-reversibility of the handle member 26 in relation to the floor engaging head 8. Non-reversibility is necessary because the principles of force transmission embodied in the proper and acceptable operation of my invention, described further hereafter, are not symmetric.

Third, it is critical that the pin 30 be located in a back half of the completely slotted center portion 24. By placing the pin in this particular location, in operation the pushing force 48 thereby utilizes a low center of mass of the floor engaging head 8 to insure transmission of the pushing force through the handle member and into the floor engaging head in the forward direction 3 parallel to the bottom plate 14. Stated equivalently, the vertical component of the pushing force 48 imparted to the handle member by the operator is neutralized and/or translated by the pivotally mounted handle member into the forward horizontal direction 3. Thus, the bottom plate will be maintained in a substantially parallel relationship with the floor surface when the floor engaging head is pushed in the forward direction 3 across the floor surface.

This third feature is necessary to best efficiently and effectively achieve the purpose of my article collector, namely, collecting various articles (not shown in the drawings) on a floor surface and bringing them to a desired location. Were the pin 30 to be located in the front half of the completely slotted center portion, then the vertical component of the pushing force 48 would cause a front bottom edge 53 of the bottom plate 14 to tend to catch on the floor surface reducing the effective force available to collect articles as well as causing the floor engaging head to want to roll over forward onto itself.

Another feature of my invention I have provided is the outer surface 58 of the front end of the handle member being co-planar with a top surface 60 of the pair of shoulder members 18 when the angle 50 between the handle member and the bottom plate is about 0 degrees. This feature enables positioning of the article collector 2 in a flat storage position (not specifically shown). Further, when the article collector 2 is in the flat storage position it is still operable to push in the forward direction 3 to collect articles located on the floor surface under a sofa, other furniture and the like.

As various possible materials may be used to construct my invention, including wood, synthetic plastic and metal, excellent results are obtained when the material used for the bottom plate 14, the pair of shoulder members 18 and the handle member 26 is solid wood. Further, the preferred material for the pin 30 is a rigid metal, such as steel or the like. Finally, my invention could equally be constructed of synthetic plastic where the floor engaging head 8 comprises a one-piece integrally molded construction, the pair of shoulder members and the bottom plate being one piece.

The preferred embodiment of my invention as defined in the drawings is constructed as follows. The floor engaging head 8 is constructed with the bottom plate 14 having a height of about three-quarters of an inch and a length of about twenty-four inches. The pair of shoulder members 18 are constructed from a single piece having a height of about one and seven-eighths inches and being sized to overlay the bottom plate 14 so that the shoulder members 18 have a width coinciding at every point with a width of the bottom plate 14. Further the single piece is sized to overlay the bottom plate 14 having a length coinciding with a length of the bottom plate. At this point in the manufacturing process, the single piece is temporarily clamped to the bottom plate 14.

Now, concave front surface portion 16 is cut into the front of the floor engaging head. At this point, the overall width of the floor engaging head midway between the first end 10 and the second end 12 is about two and one-half inches. At the ends 10 and 12, the width of the floor engaging head is about three and one-half inches. After cutting the concave front surface portion 16 into the front of the floor engaging head, the bottom plate 14 is marked for grooving the partially slotted center portion 20 located substantially midway between the first end 10 and the second end 12 of the bottom plate. Concurrently, the single piece to be the pair of shoulder members 18 is marked for cutting the completely slotted center portion 24 directly overlying and coinciding with the partially slotted center portion 20. Now, the single piece is unclamped from the bottom plate 14.

Next, the partially slotted center portion 20 is grooved into the bottom plate 14. Then, the completely slotted center portion 24 is cut in the single piece thereby forming the pair of shoulder members 18. The partially slotted center portion 20 is set about three-eighths of an inch deep in the bottom plate and has a width of about one and three-eighths inches. Consequently, the completely slotted center portion 24 directly overlying and coinciding with the partially slotted center portion 20 has a width of about one and three-eighths inches.

Next, though this step could be completed later as well, fitted holes 25 located in the back half of the completely slotted center portion 24 are drilled in the pair of shoulder members for rigidly securing the pin 30 therein. Fitted holes 25 are preferably located three-quarters of an inch in front of a back edge 47 and one inch above the bottom portion 22. More important than the exact distance the fitted holes 25 are located above the bottom portion 22 is locating them such that the spaced relation 42 between the angled front tip 52 and the bottom portion 22 is in the range of about one-eighth to three-eighths of an inch. This range for spacing is critical to achieve the pivotal features of my invention while also employing the low center of mass of the floor engaging head.

Then, though this step could be completed earlier as well, the front end 28 of the handle member 26 is cut to form the angled front tip 52 having an angle of about 60 degrees relative to the longitudinal axis of the handle member. The handle member 26 has a diameter of about one and one-quarter inches and is about four to five feet long. Then, a horizontal hole 27 is drilled in the handle member 26 for loosely fitted engagement with the pin 30, which is then inserted therethrough. This hole 27 is preferably located one and one-half inches back from an end most point of the front end.

The front end 28 of the handle member is then placed between the pair of shoulder members and in the completely slotted center portion 24. The first and second ends of the pin are inserted within respective fitted holes 25 of the pair of shoulder members and are thereby rigidly secured therein. Next, the pair of shoulder members and the handle member are placed on top of the bottom plate 14 and the pair of shoulder members 18. Finally, slightly smaller sized holes than the size of the wood-type metal screw fastening means 15 are drilled to accommodate the wood-type metal screw fastening means 15, though pre-drilled holes are not essential. The wood-type metal screw fastening means 15 are then screwed into the predrilled holes and through the pair of shoulder members and into the bottom plate 14 rigidly securing the three pieces together. My brushless handle controlled article collector is now fully assembled and ready for use.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A brushless handle controlled article collector for collecting articles positioned at various locations on a floor surface comprising:

a rigid elongated floor engaging head having a first end and a second end;

said rigid elongated floor engaging head further defined by a bottom plate, a concave front surface portion, and a pair of shoulder members overlying the bottom plate;

said bottom plate having a partially slotted center portion located substantially midway between the first end and the second end of the rigid elongated floor engaging head;

the partially slotted center portion having a bottom portion;

each of said pair of shoulder members independently rigidly connected to the bottom plate and being separated by a completely slotted center portion directly overlying and coinciding with the partially slotted center portion, each member of the pair of shoulder members extending away from the completely slotted center portion in an opposite direction;

a handle member having a front end;

a pin having a first end and a second end;

said pin pivotally mounting the front end of the handle member in spaced relation above the bottom portion of the partially slotted center portion, said pin extending through a width of the front end of the handle member and traversing a distance between the pair of shoulder members within the completely slotted center portion, the first and second ends of the pin projecting within each respective member of the pair of shoulder members and being rigidly secured therein;

the bottom plate having a smooth substantially flat bottom planar surface for slidably engaging said floor surface; and, said concave front surface portion adapted to collect said articles positioned at various locations on the floor surface and to maintain said articles in relative position between the first end and the second end of the rigid elongated floor engaging head when the rigid elongated floor engaging head is pushed in a forward direction across the floor surface to collect said articles.

2. The brushless handle controlled article collector of claim 1, wherein the bottom plate is maintained in a substantially parallel relationship with the floor surface when the rigid elongated floor engaging head is pushed in the forward direction across the floor surface.

3. The brushless handle controlled article collector of claim 1, wherein said pin is located in a back half of the completely slotted center portion thereby utilizing a low center of mass in the rigid elongated floor engaging head to insure transmission of a pushing force through the handle member and into the rigid elongated floor engaging head while said bottom plate is maintained in a substantially parallel relationship with the floor surface when the rigid elongated floor engaging head is pushed in the forward direction across the floor surface.

4. The brushless handle controlled article collector of claim 1, wherein an angle in a range of about 0 degrees to about 60 degrees between the handle member and the bottom plate is maintained when the rigid elongated floor engaging head is pushed in the forward direction across the floor surface.

5. The brushless handle controlled article collector of claim 1, wherein the front end of the handle member is further defined by an angled front tip, said angled front tip being suspended above the bottom portion of the partially slotted center portion when an angle between the handle member and the bottom plate is in a range of about 0 degrees to about 60 degrees.

6. The brushless handle controlled article collector of claim 5, wherein said angled front tip contacts a stop point in a front half of the bottom portion of the partially slotted center portion when the angle between the handle member and the bottom plate is greater than about 60 degrees thereby insuring non-reversibility of the handle member in relation to the rigid elongated floor engaging head.

7. The brushless handle controlled article collector of claim 6, wherein an outer surface of the front end of the handle member is co-planar with a top surface of the pair of shoulder members when the angle between the handle member and the bottom plate is about 0 degrees thereby positioning the brushless handle controlled article collector in a flat storage position.

8. The brushless handle controlled article collector of claim 1, wherein said rigid elongated floor engaging head is of a one-piece integrally molded construction.

9. The brushless handle controlled article collector of claim 1, wherein the rigid elongated floor engaging head is constructed from one of the materials comprising wood, synthetic plastic and metal.

10. The brushless handle controlled article collector of claim 1, wherein said rigid elongated floor engaging head has a length of about twenty-four inches, a width of about three and one-half inches and a height of about two inches.

11. A handle controlled article collector for collecting articles on a floor surface comprising:

a rigid elongated floor engaging head having a first end and a second end;

said rigid elongated floor engaging head is further defined by a bottom plate, a concave front surface portion, and a pair of shoulder members overlying the bottom plate and integrally connected therewith;

said pair of shoulder members separated by a completely slotted center portion located substantially midway between the first end and the second end of the rigid elongated floor engaging head, each member of the pair of shoulder members extending away from the completely slotted center portion in an opposite direction;

the completely slotted center portion having a bottom portion;

a pin having a first end and a second end;

a handle member having a front end;

the front end of the handle member pivotally mounted in spaced relation above the bottom portion of the completely slotted center portion and in the completely slotted center portion by the pin, said pin extending through the front end of the handle member, said pin rigidly secured at the first end and the second end of the pin to each respective member of the pair of shoulder members;

the bottom plate having a smooth substantially flat bottom planar surface for slidably engaging said floor surface;

said concave front surface portion adapted to collect said articles on the floor surface and to maintain said articles in relative position between the first end and the second end of the rigid elongated floor engaging head when the rigid elongated floor engaging head is pushed in a forward direction across the floor surface to collect said articles.

* * * * *